US006755713B1

(12) United States Patent
Weber et al.

(10) Patent No.: US 6,755,713 B1
(45) Date of Patent: Jun. 29, 2004

(54) TOY WITH CORRELATED AUDIBLE AND VISUAL OUTPUTS

(75) Inventors: Gary Weber, Buffalo, NY (US); Robert Sonner, South Wales, NY (US); Christopher J. Hayes, West Falls, NY (US); Albert Maggiore, Lancaster, NY (US); Nancy M. Cariffe, East Aurora, NY (US)

(73) Assignee: Mattel, El Segundo, CA (US)

( * ) Notice: Subject to any disclaimer, the term of this patent is extended or adjusted under 35 U.S.C. 154(b) by 0 days.

(21) Appl. No.: 10/431,584

(22) Filed: May 8, 2003

(51) Int. Cl.[7] ..... A63H 33/00
(52) U.S. Cl. ..... 446/143; 446/175; 446/485
(58) Field of Search ..... 446/7, 82, 143, 446/147, 149, 175, 397, 484, 485

(56) References Cited

U.S. PATENT DOCUMENTS

| | | | |
|---|---|---|---|
| 243,096 | A | 6/1881 | Bailey |
| 491,833 | A | 2/1893 | Bowen et al. |
| 672,678 | A | 4/1901 | Kitching |
| 1,133,773 | A | 3/1915 | Widdis |
| 1,200,658 | A | 10/1916 | Senf |
| 1,309,915 | A | 7/1919 | Siegel |
| 1,337,937 | A | 4/1920 | Maxwell |
| 1,382,423 | A | 6/1921 | Hadley |
| 1,403,947 | A | 1/1922 | Hadley |
| 1,403,948 | A | 1/1922 | Hadley |
| 1,403,949 | A | 1/1922 | Hadley |
| 1,403,950 | A | 1/1922 | Hadley |
| 1,403,951 | A | 1/1922 | Hadley |
| 1,431,890 | A | 10/1922 | Hadley |
| 1,571,868 | A | 2/1926 | Parsons |
| 1,616,753 | A | 2/1927 | Marx |
| 1,739,569 | A | 12/1929 | Behn |
| 1,843,841 | A | 2/1932 | Ryerson |
| 2,132,297 | A | 10/1938 | Horowitz |
| 2,242,611 | A | 5/1941 | Kunen |
| D142,322 | S | 8/1945 | Judd |
| 2,383,305 | A | 8/1945 | Greene |
| 2,416,959 | A | 3/1947 | Segal |
| D155,798 | S | 11/1949 | Gaulke |
| 2,596,866 | A | 5/1952 | Portogallo |
| 2,731,871 | A | 1/1956 | Loughire |
| 2,747,297 | A | 5/1956 | Zalkind |
| 2,788,608 | A | 4/1957 | Anthony |
| 2,788,697 | A | 4/1957 | Anthony |
| 2,879,685 | A | 3/1959 | Page |
| 2,888,849 | A | 6/1959 | Humphrey et al. |
| 3,164,924 | A | 1/1965 | Iwaya et al. |
| 3,186,291 | A | 6/1965 | Pedicano |
| 3,196,731 | A | 7/1965 | Ingley |

(List continued on next page.)

FOREIGN PATENT DOCUMENTS

| | | | |
|---|---|---|---|
| CH | 658533 | A5 | 11/1986 |
| DE | 459386 | | 8/1928 |
| DE | 901731 | | 1/1954 |
| FR | 587965 | | 4/1925 |
| FR | 1200658 | | 12/1959 |
| FR | 2680113 | A3 | 2/1993 |
| GB | 2112990 | A | 7/1983 |
| JP | 52-31725 | | 3/1977 |
| JP | 0634770 | A | 12/1994 |

*Primary Examiner*—Jacob K. Ackun, Jr.
(74) *Attorney, Agent, or Firm*—Cooley Godward LLP

(57) ABSTRACT

The invention includes a toy having a translucent body that includes a first surface and a second surface. A light source is disposed opposite the first surface. The first surface includes an image of a facial feature in a first position and the second surface includes an image of the same facial feature in a second position. When the light source is illuminated, the facial feature appears to be in the first position and when the light source is not illuminated, the facial feature appears to be in the second position. An audible output generator produced audible output simultaneously with illumination of the light source.

27 Claims, 12 Drawing Sheets

U.S. PATENT DOCUMENTS

D206,487 S 12/1966 Ryan
3,420,135 A 1/1969 Wolf
3,477,332 A 11/1969 Kreiss
3,538,620 A 11/1970 Kohner et al.
3,595,121 A 7/1971 Magers
3,742,642 A 7/1973 Horn
3,760,511 A 9/1973 Matsumoto
D228,932 S 10/1973 Smith, III et al.
3,795,989 A 3/1974 Greenberg et al.
D232,574 S 8/1974 Satten
3,977,292 A 8/1976 Favilli et al.
D248,584 S 7/1978 Snyder
4,114,501 A 9/1978 Tanaka
4,121,488 A 10/1978 Akiyama
4,149,717 A 4/1979 Seijiro
4,195,421 A 4/1980 Tucker et al.
4,203,344 A 5/1980 Krosnick
4,211,029 A 7/1980 Cretin
4,271,744 A 6/1981 Kulesza
4,344,346 A 8/1982 Erickson et al.
4,353,701 A 10/1982 Greenberg
4,385,762 A 5/1983 Schwartz
D269,289 S 6/1983 Nakao et al.
4,391,061 A 7/1983 Fogarty et al.
D271,897 S 12/1983 Ma
4,429,607 A 2/1984 Meno
4,479,329 A 10/1984 Fraden
4,508,512 A 4/1985 Girsch et al.
4,509,920 A 4/1985 Kaufmann
D282,940 S 3/1986 Thomson et al.
4,609,356 A 9/1986 Gilden et al.
4,610,637 A 9/1986 Ferguson
4,659,919 A 4/1987 Price
4,664,396 A 5/1987 Pietrafesa
4,675,519 A 6/1987 Price
D291,583 S 8/1987 Bateman et al.
D292,012 S 9/1987 Thomson et al.
4,733,591 A 3/1988 Kaneko et al.
4,737,134 A * 4/1988 Rumsey ..... 446/409
D296,451 S 6/1988 Ming
4,781,099 A 11/1988 Koike
4,794,840 A 1/1989 Isashi
4,827,826 A 5/1989 Isashi
4,846,692 A 7/1989 Delcambre
4,924,743 A 5/1990 Tsai
4,930,236 A 6/1990 Hart
D310,394 S 9/1990 Roy et al.
D315,178 S 3/1991 Takahashi et al.
5,011,412 A 4/1991 Rosenberg
D319,082 S 8/1991 Harris
5,045,687 A 9/1991 Gurner
D321,022 S 10/1991 Mariol
5,139,453 A 8/1992 Aiken et al.
5,145,447 A 9/1992 Goldfarb
5,188,533 A 2/1993 Wood
5,217,402 A 6/1993 Gross et al.
D339,173 S 9/1993 Marschak
D345,387 S 3/1994 Yan
5,304,084 A 4/1994 Liao
5,314,338 A 5/1994 Caveza et al.
D348,483 S 7/1994 Chow et al.
D349,300 S 8/1994 Lau
5,364,272 A 11/1994 Herman et al.
D353,164 S 12/1994 Meei-Lin
5,415,071 A 5/1995 Davies
D361,798 S 8/1995 Kino
5,438,154 A 8/1995 Segan et al.
5,439,407 A 8/1995 Friedel
D362,469 S 9/1995 Kino
5,451,178 A * 9/1995 Yorozu et al. ..... 446/175
5,454,745 A 10/1995 Spielberger
5,478,268 A 12/1995 Au
D366,286 S 1/1996 Kino
5,501,601 A 3/1996 Todokoro et al.
5,540,132 A 7/1996 Hale
5,545,071 A 8/1996 Shiraishi
D374,691 S 10/1996 Chow et al.
5,573,407 A 11/1996 Dunford
5,637,996 A 6/1997 McDarren et al.
5,668,333 A 9/1997 Horton et al.
5,674,103 A 10/1997 Bean
D387,814 S 12/1997 Chow et al.
5,788,253 A 8/1998 Thomson et al.
D400,937 S 11/1998 Lun
5,841,051 A 11/1998 Segan
D413,149 S 8/1999 Chan et al.
5,944,254 A 8/1999 Liu
5,984,758 A 11/1999 Driska et al.
D417,473 S 12/1999 Wise et al.
D420,060 S 2/2000 Yamazaki
D422,034 S 3/2000 Yamazaki
6,084,527 A 7/2000 Spector
6,142,849 A * 11/2000 Horton et al. ..... 446/175
6,165,037 A 12/2000 Van Zant
6,203,395 B1 3/2001 McElhaney
6,206,384 B1 3/2001 Chi et al.
6,231,345 B1 5/2001 Yamazaki et al.
6,253,058 B1 6/2001 Murasaki et al.
D450,782 S 11/2001 Chan
D451,970 S 12/2001 Chan
6,332,824 B2 12/2001 Tell et al.
6,337,434 B2 1/2002 Oren-Chazon

* cited by examiner

10
USER INPUT
20
MODE SELECTOR
22
ACTUATOR
24
ACTUATOR
24
130
CONTROLLER
CONTROL
LOGIC
30
32
OUTPUT
40
OUTPUT CONTENT
AUDIO
VIDEO
42A
42B
42
OUTPUT GENERATOR
44
AUDIO OUTPUT GENERATOR
45
SIGNAL GENERATOR
45A
AUDIO TRANSDUCER
45B
VIDEO OUTPUT GENERATOR
46
SIGNAL GENERATOR
46A
VIDEO TRANSDUCER
46B

TOY WITH CORRELATED AUDIBLE AND VISUAL OUTPUTS

BACKGROUND

Field of the Invention

The invention relates to children's toys with audible and visual outputs, and more particularly to children's toys with audible and visual outputs that are correlated.

Children's toys can produce a variety of lights and sounds based on actuation by a user. For example, children's toys include actuators that cause the output of lights and/or sounds in various patterns. Children's toys that use such an arrangement do not necessarily coordinate the lights and sounds. Moreover, even when the lights and sounds are coordinated, the light that is output by the toy is often simply an illumination of a shape and/or colored lens. While the illumination of the simple figures may entertain a child, such an output may not maintain the child's attention for extended periods of time.

What is needed is a children's toy that has corresponding audible and visual outputs where the visual output is a recognizable facial feature or similar output.

SUMMARY OF THE INVENTION

The invention includes a toy having a translucent body that includes a first surface and a second surface. A light source is disposed opposite the first surface. The first surface includes an image of a facial feature in a first position and the second surface includes an image of the same facial feature in a second position. When the light source is illuminated, the facial feature appears to be in the first position and when the light source is not illuminated, the facial feature appears to be in the second position. An audible output generator produced audible output simultaneously with illumination of the light source.

These and other aspects of the invention will become apparent from the following drawings and description.

BRIEF DESCRIPTION OF THE DRAWINGS

The invention is described with reference to the accompanying drawings. In the drawings, like reference numbers indicate similar elements.

DETAILED DESCRIPTION

Several embodiments of a children's entertainment device or toy 10 incorporating the principles of the invention are shown in FIGS. 1–14. A functional description of the toy is presented first, followed by a description of various implementations.

Figure 1:
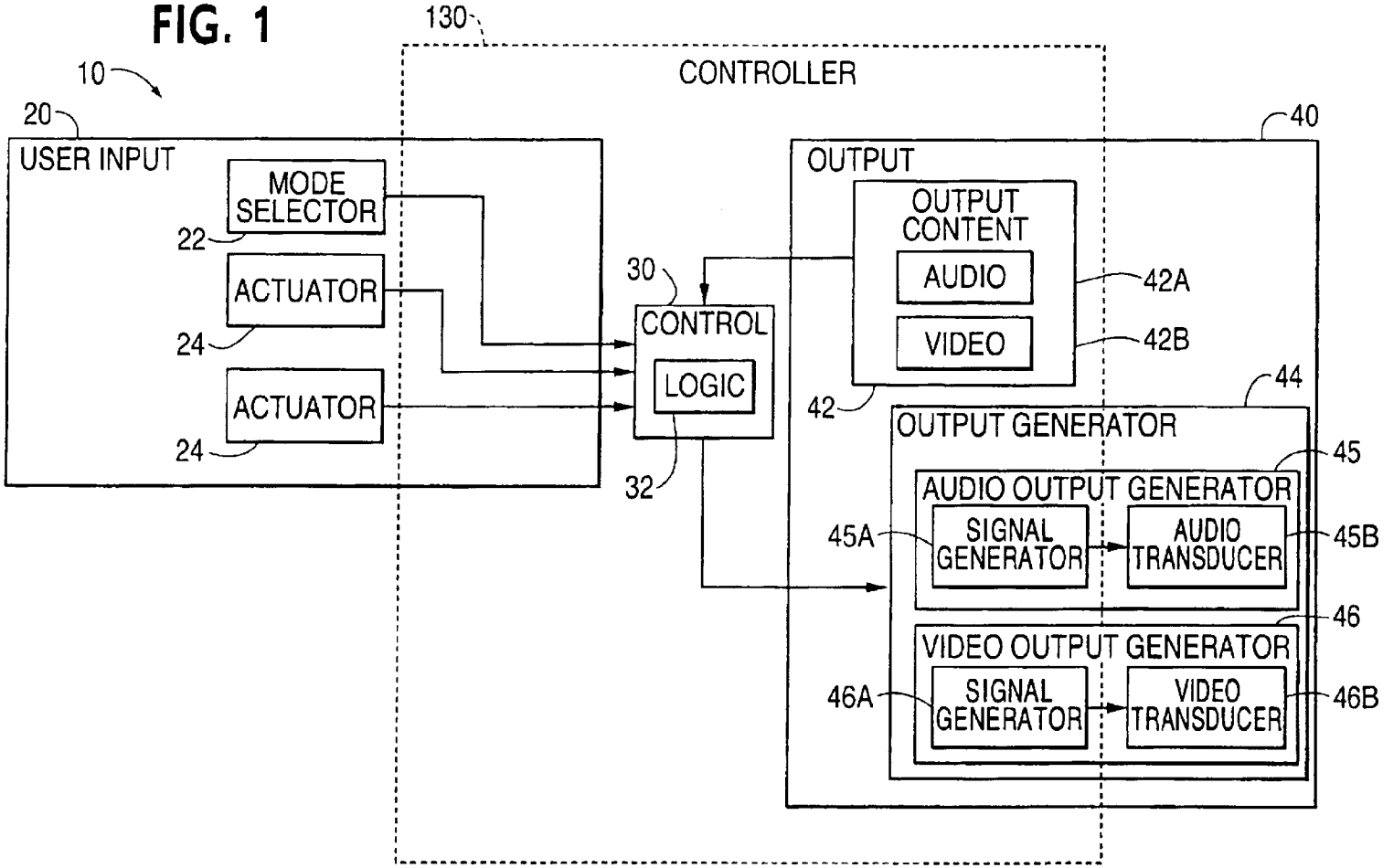
FIG. 1 is a functional block diagram of an embodiment of a toy according to the invention.

FIG. 1 is a schematic illustration of the relationship of various components of the toy 10. As shown in the functional block diagram of FIG. 1, the toy 10 includes a user input block 20, a control block 30, and an output block 40. In response to user input via the input block 20, the control block controls the output of selected output, such as musical notes, sound effects, light patterns or combinations of musical notes and light patterns from the output block 40. Regardless of the configuration and/or orientation of the toy 10, the functionality described with respect to FIG. 1 is generally the same.

Output block 40 includes output content 42, which includes audio content 42A, and video content 42B. Audio content 42A can include, for example, in either digital or analog form, musical notes (which can be combined to form musical compositions), speech (recorded or synthesized), or sounds. Video content can include, for example, in analog or digital form, still or video images, or simply control signals for activation of lamps or other light emitting devices.

The output content can be communicated to a user for hearing, or viewing, by output generator 44, which can include an audio output generator 45, and a video output generator 46. Audio output generator 45 can include an audio signal generator 45A which converts audio output content 42A into signals suitable for driving audio transducer 45B, such as a speaker, for converting the signals into audible sound waves. Video output generator 46 can include a video signal generator 46A, which converts video output content 42B into signals suitable for driving a video transducer 46B, such as a display screen or lights, for converting the signals into visible light waves. Video output generator 46 can also include moving physical objects. Toy 10 can include more than one audio transducer 45B and more than one video transducer 46B. The multiple audio transducers and video transducers may be similar or different with respect to one another. The selection of the output content and the performance attributes of the output generators should be driven by the goal of generating output that is appealing or entertaining to a user.

Control block 30 controls output block 40, selecting the output content to the output and activating the output generator 44 to operate on the selected output content. The operation of control block 30 can be governed by control logic 32, which can be, for example, computer software code. Control logic 32 can select content to be output repetitively or non-repetitively, and/or randomly or in fixed sequences. The video and audio output can be coordinated to enhance the entertainment effect to the child.

User input block 20 includes a mode selector 22, one or more actuators 24, by which the user can provide input to control block 30 to influence the selection of output content and to initiate its output. Mode selector 22 allows the user to select from among various output modes. Illustrated output modes include variations of combined video and audio output. For example, the audio content 42A can include a set of musical tones and a set of spoken words, and the video content can include a selected sequence of illumination instructions for lamps. Control logic 32 includes sets of sequences in which the musical tones can be output to produce recognizable tunes. Various modes of light operation may be selected. A program can include a predetermined sequential output of the sets of tone sequences, producing a sequence of musical tunes. Lamps can be illuminated in response to a set of illumination instructions correlated with the playing of the tunes.

The actuators 24 allow the user to input simple commands such as "start," "stop," or "repeat" via simple mechanisms such as mechanical contact switches.

Figure 2:
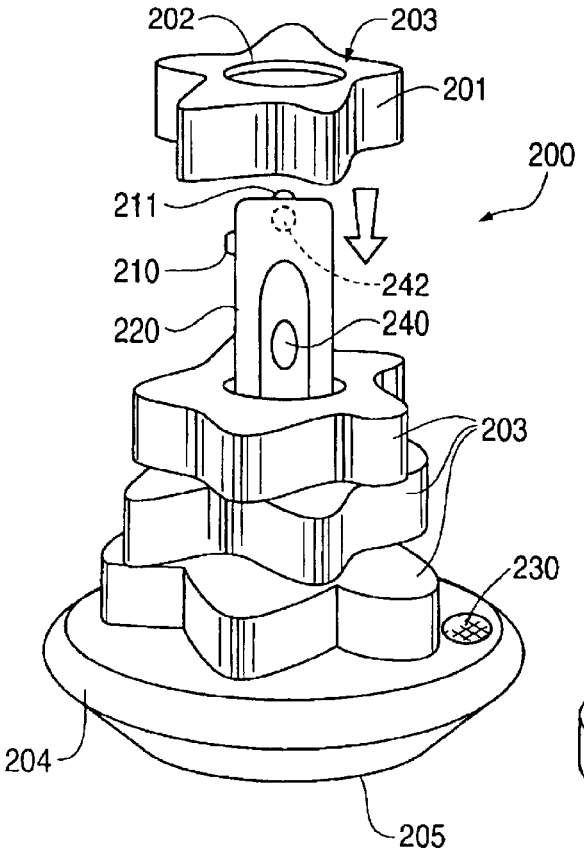
FIG. 2 is a perspective view of another embodiment of a toy embodying the principles of the invention.
Figure 3:
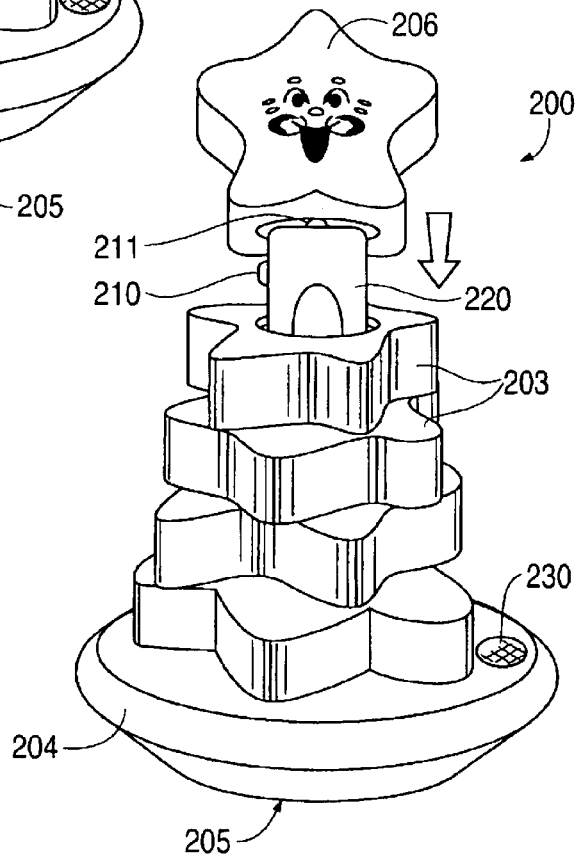
FIG. 3 is a perspective view of the toy of FIG. 3 shown in an alternative configuration.
Figure 4:
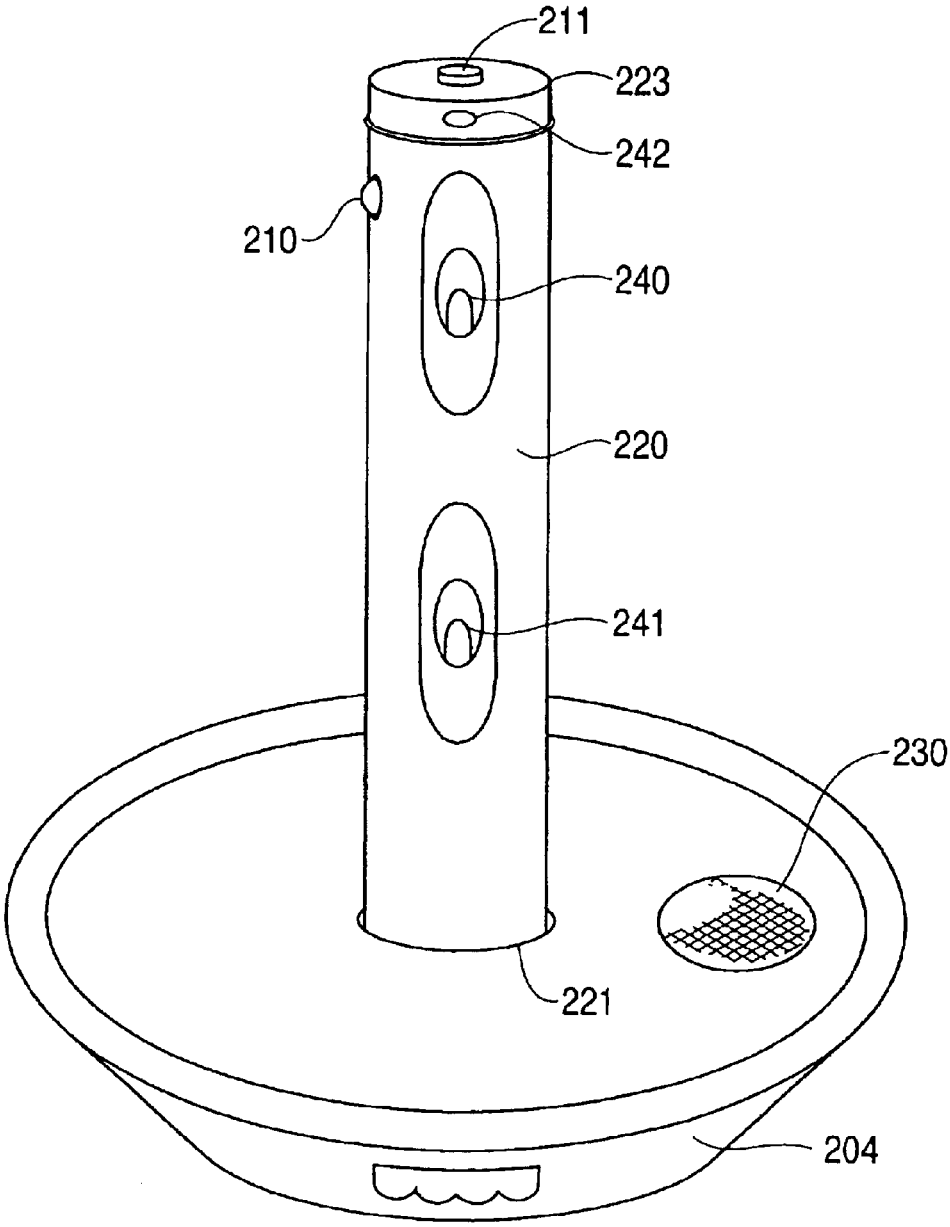
FIG. 4 is a perspective view of the support component of the toy illustrated in FIG. 2.

One implementation of the toy 10 discussed above is described with reference to FIGS. 2 through 7. The toy 200 includes a base 204 and a support post 220. In the illustrated embodiment, the support post 220 includes a first end 221 that is coupled to the base 204 and a second end 223 spaced above the base 204. The base 204 can include a substantially planar bottom as illustrated in FIG. 4 or may alternatively include an arcuate portion 205 as illustrated in FIGS. 2 and 3.

Support post 220 includes video transducers, or lights, 240, 241 and 242 disposed within the support post 220. The lights can be selectively actuated as discussed below. Base 204 includes an audio transducer, or speaker, 230.

The toy 200 includes toy articles 203 that are configured to engage support post 220. The toy articles 203 can be formed in any suitable shape or combination of shapes, such as a box, cylinder, star, toroid, or the like. At least a portion of articles 203 can be fabricated from a translucent material such that light can pass through the articles from light sources 240, 241 when the articles 203 are positioned on the support post 220.

Toy article 203 includes a body portion 201 and an engagement portion 202. The engagement portion 202 can be an opening in the article 203, that passes completely through the article 203, and that is configured to slidably engage support post 220. Regardless of the shape of the engagement portion 202, the articles can be positioned on the post in the direction indicated by the arrow in FIG. 2, and removed in the opposite direction.

A first actuator 210 is disposed on support post 220. The actuator 210 can be positioned proximate to the second end 223 of the post 220 such that each time an article 203 is placed on support post 220, the engagement portion 202 of the article 203 engages the actuator 210, causing the output of sound and lights.

A top article 206 is included and is configured to engage the second end 223 of support post 220. Top article 206 can include a recess 209 (best illustrated in FIGS. 5 to 7) that is configured to receive at least a portion of support post 220. Within recess 209 is a protrusion or post 229.

The support post 220 can include a second actuator 211 positioned at the second end 223 of the support post 220. The second actuator 211 can be coaxial with the support post 220. The post 229 of top article 206 is configured to engage actuator 211 when the top article 206 is placed on the support post 220 as indicated by the arrow in FIG. 6. The actuator 211 can be spring loaded such that a predetermined amount of force is required to be imparted to the actuator 211, via the top article 206, for the actuator 211 to be activated.

Light source 242 can be positioned adjacent actuator 211. Regardless of the position of the light source 242, light source 242 is configured such that light can be directed through top article 206 when top article 206 is positioned on support post 220.

Figure 6:
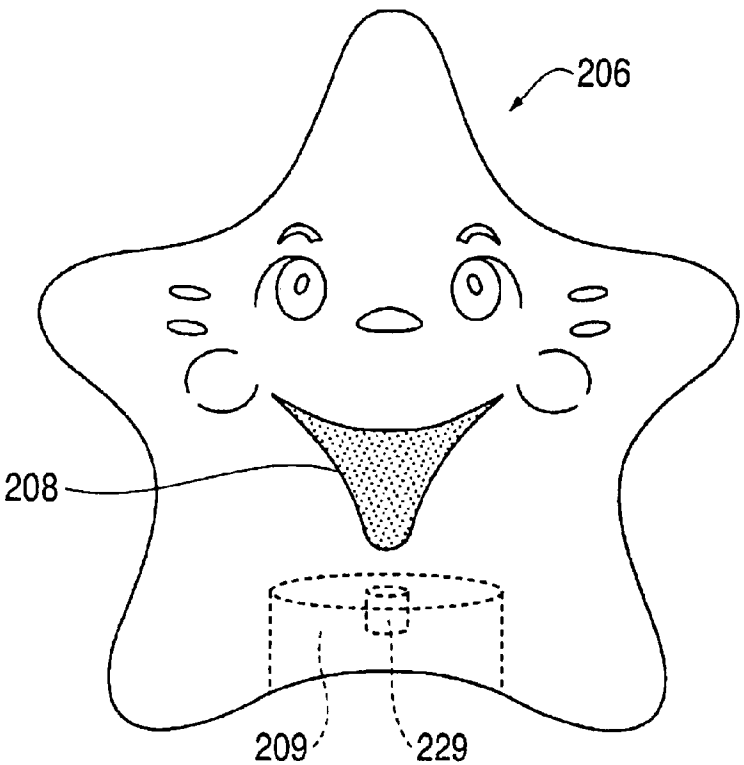
FIG. 6 is a front view of the element illustrated in FIG. 5, shown in a second stage of use.
Figure 5:
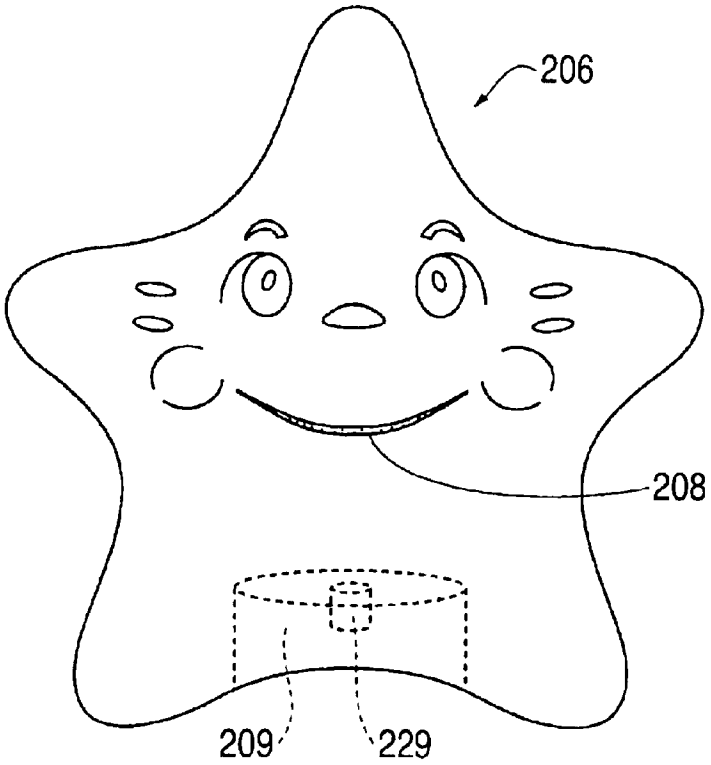
FIG. 5 is a front view of an element of the toy illustrated in FIG. 2 shown in a first stage of use.
Figure 7:
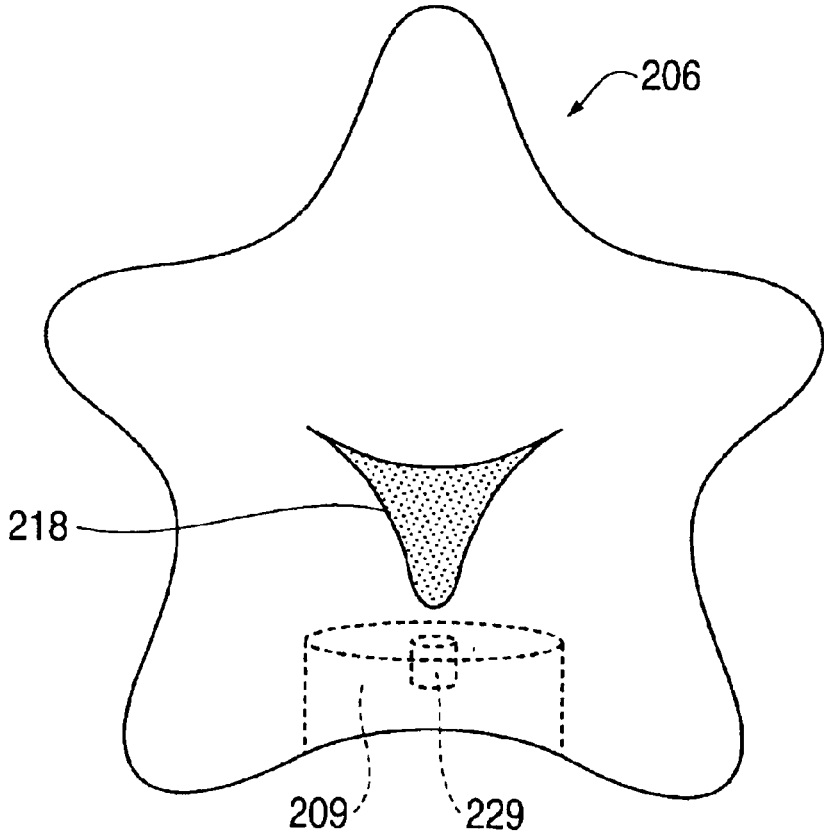
FIG. 7 is a rear view of the interior portion of the element illustrated in FIG. 5.

Top article 206 is fabricated at least partially from a translucent material and has an exterior surface and an interior surface. Various facial features 208 are included on the exterior surface of the article 206. The facial features 208 can be produced by known means such as painting, molding, screening, printing and the like. A second image 218 is included on the interior surface of the article 206 as illustrated in FIG. 7. The second image 218 is representative of a facial feature in a second position. For example, in the illustrated embodiment, the facial feature 218 included on the interior surface of the article 206 is a mouth in an open position. Whereas, the facial features included on the exterior surface of the article 206 include a mouth in a closed position. When light is shone through article 206, thereby illuminating the article 206, the second image 218 is visible through the exterior surface of the article 206 to give the appearance that the mouth is open. When the article 206 is not illuminated (as illustrated in FIG. 5), the face appears to have a mouth in a closed position. When the article is illuminated (as illustrated in FIG. 6), the image is a face with the mouth in an open position. Toy 200 includes a controller 250, which performs the functions of control block 30 described above with reference to FIG. 1. In the illustrated embodiment, controller 250 can be a model SN66021 controller available from Sonix Corporation. The controller 250 responds to actuation of momentary contact switches (not illustrated) that are engaged, for example, the buttons indicated as actuators 210, 211. Output lines from the various actuators/switches are coupled to controller 250 to provide signals to cause the operation of the controller.

The controller 250 is operative to select stored content to be output as discussed above. The controller includes tone identifiers arranged in sequences corresponding to musical tunes. Sets of tone identifiers are stored, allowing generation of musical tunes, such as, Vivaldi's Spring, Brandenburg Concerto, Strauss Waltz, Twinkle Twinkle Little Star, etc. The controller is further operative to coordinate the output of lights and sounds as discussed below.

In operation, a user can place articles 203 on the support post 220, thereby engaging actuator 210 and causing the audible and visual output (i.e., lights and sound). As the light sources 240 and 241 along the support post 220 are illuminated, light passes through the articles 203, causing an entertaining effect for the user.

When the user places top article 206 on the top portion 223 of the support post 220, thereby depressing actuator 211, light sources 240, 241 and 242 are illuminated and sounds are output through speaker 230. When the light source 242 on the top portion of the support post 220 is illuminated, thereby passing into top article 206, the facial features 208 on the article 206 are modified as discussed above.

The light sources 240, 241 and 242 and the music/tones are coordinated such that as the music is playing the lights are illuminated, thereby giving the appearance that the image 208 of the face on the top article 206 is singing along with the music and voicing the tones being produced. The article 206 can also include other changing facial features such as eyes that open and close based on whether or not the light source 242 is illuminated.

The output of lights and sounds may be the same or may be different depending on which actuator is depressed.

The audible output may include vocals from a song, such that when the light source 242 is illuminated and the vocals are output, the mouth appears to move in unison with the vocals.

Another implementation of the toy 10 is now described with reference to FIGS. 8 through 12. In the illustrated embodiment, toy 300 includes an upper housing 306 and supports 301 that are configured to maintain the housing 306 in various positions above a support surface. The housing 306 and supports 301 are reconfigurable through a variety of configurations as will be discussed below.

Included on the housing are multiple input actuators 310. In the illustrated embodiment, the input actuators are configured as keys on a keyboard. Multiple translucent articles 340 are included on the housing 306 and are selectively illuminated upon depression of one or more of the input actuators 310.

When the input actuators 310 are actuated, multiple light sources 343 (best seen in FIG. 12) are illuminated. When the input actuators 310 are actuated, audible output is also produced via speaker 330.

Upon illumination of light source 343, light passes through the corresponding article 340. As discussed above with respect to the first embodiment, the articles 340 can have images disposed on their exterior surface 341, such as facial features. Additionally, a portion of a facial feature in a different position can be positioned on the interior surface 339 of the article 340. When the light source 343 is illuminated, it appears that the facial features printed on the article are modified as discussed above.

Figure 12:
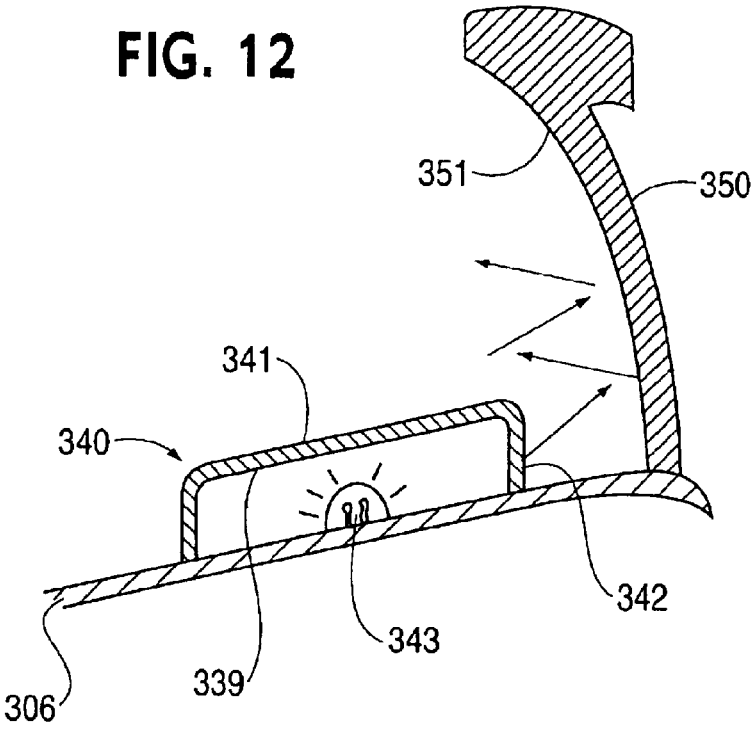
FIG. 12 is a partial cross-sectional view of the toy according to the invention taken along the line 12—12 in FIG. 8.

The articles 340 can include a substantially transparent portion 342 as illustrated in FIG. 12. When the light source 343 is illuminated, light can pass through the transparent portion 342 and can be reflected off the reflective surface 351 of an elevated member 350 that is coupled to the upper housing 306. The elevated member 350 can include tabs 352 for matably engaging recesses 353 in the housing 306.

The toy 300 can also include a second set of actuators 322 that are pivotally coupled to the lower portion 308 of housing 306. When the actuators 322 are engaged, they can selectively contact switches (now shown) to cause the actuation of audible and visual output as discussed above. The output may be similar or different depending upon which actuators 310 or 322 are engaged by the user.

Figure 8:
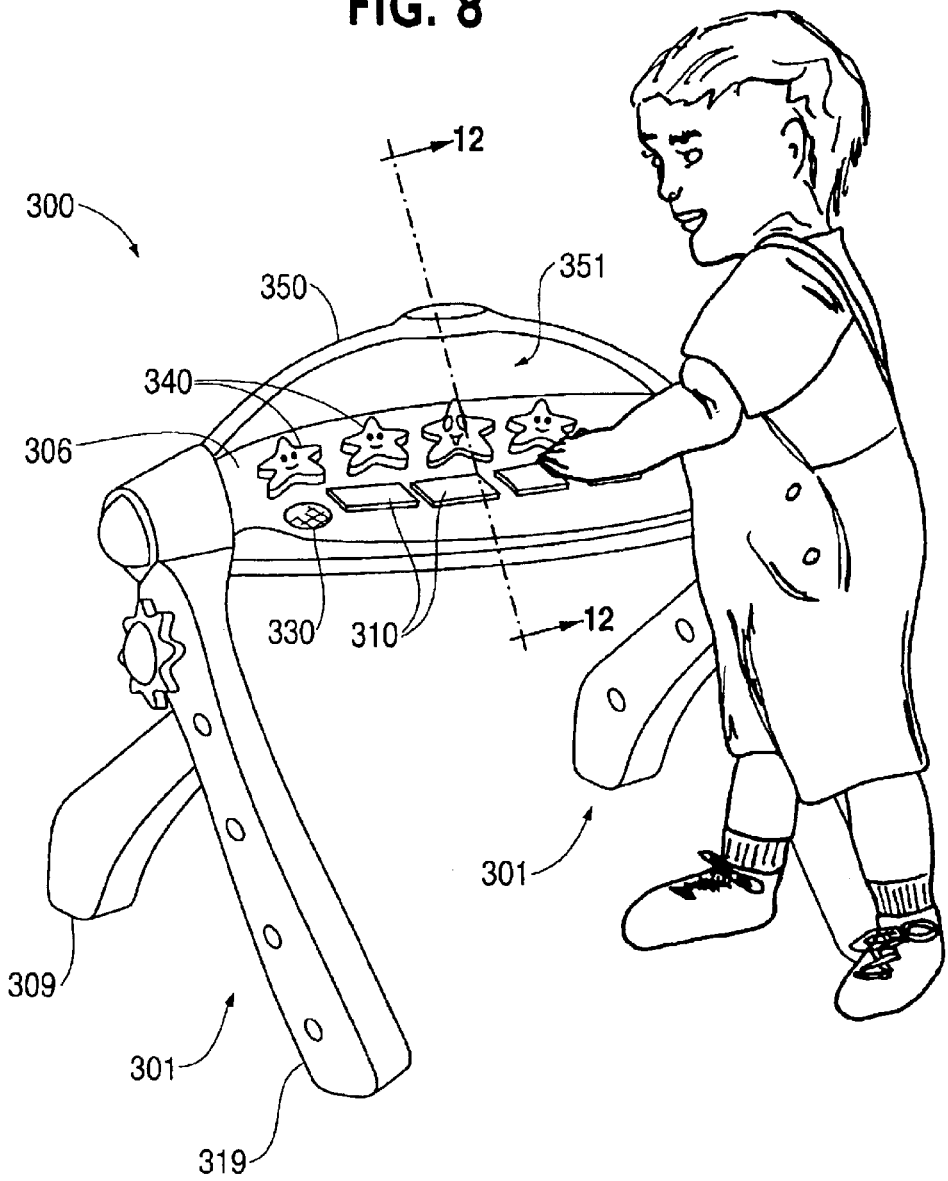
FIG. 8 is a perspective view of another embodiment of toy embodying the principles of the invention, illustrated in a first configuration.

The toy 300 can be utilized in multiple configurations. A first configuration is illustrated in FIG. 8. In the first configuration, the supports 301 maintain the housing 306 in a position suitable for use by a toddler when the toddler is in a standing position as illustrated in FIG. 8.

Figure 9:
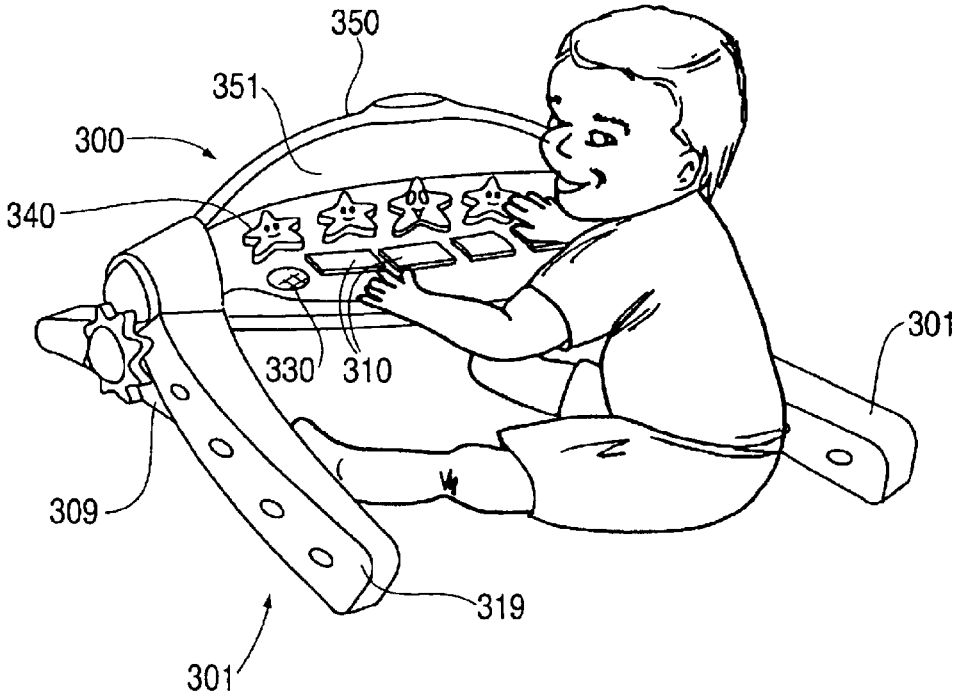
FIG. 9 is a perspective view of the embodiment illustrated in FIG. 8, shown in a second configuration.

The supports 301 can be reconfigured such that the upper housing 306 can be utilized by a child in a seated position as illustrated in FIG. 9.

Figure 10:
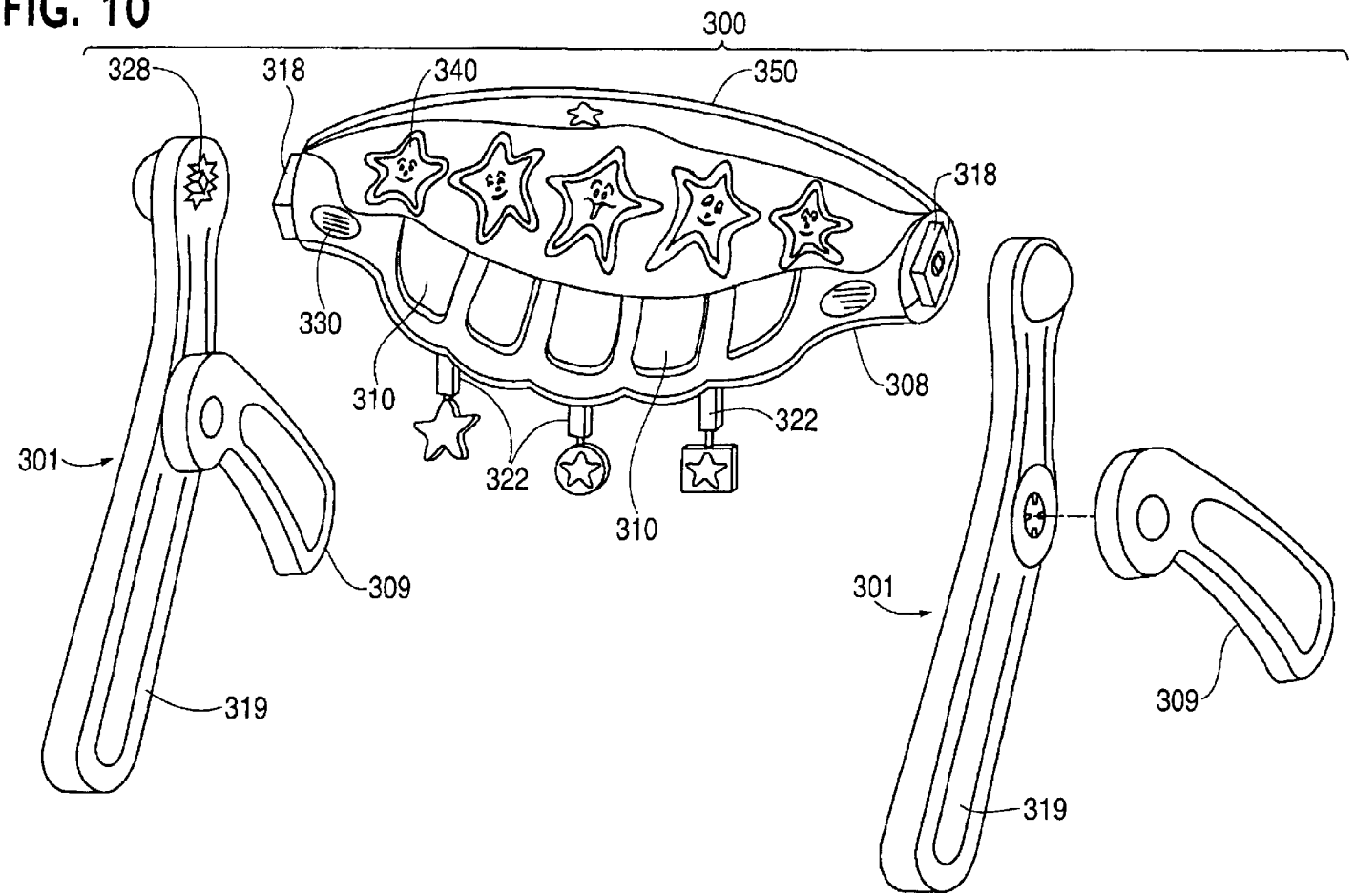
FIG. 10 is an exploded view of the device illustrated in FIG. 8.
Figure 11:
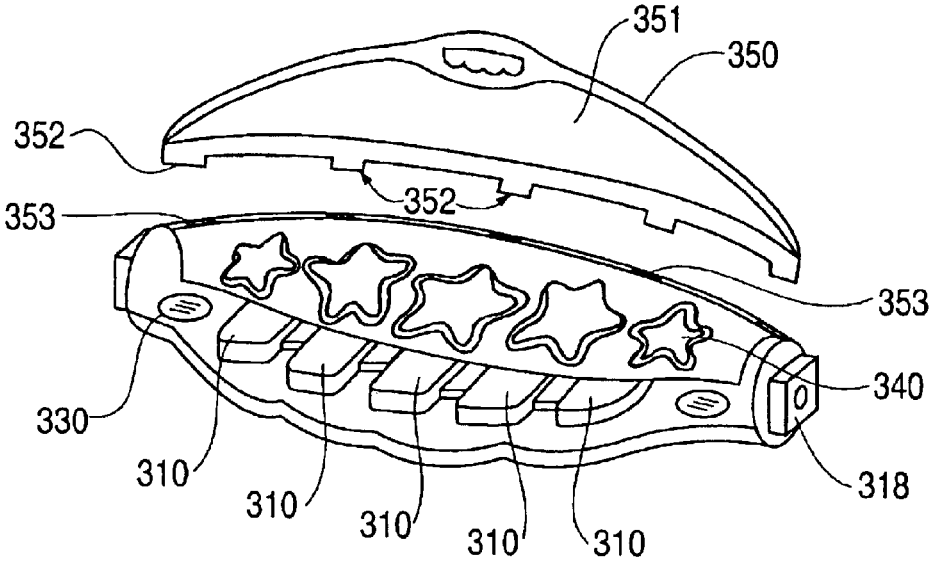
FIG. 11 is a partially exploded view of the device illustrated in FIG. 8.

In another configuration, illustrated in FIG. 10, the housing 306 can be moved such that it can be utilized by an infant lying on a support surface beneath the toy 300.

For the toy 300 to be utilized in its various configurations, the housing 306 can be repositioned to vary the orientation of the housing 306 with respect to the support surface. The supports 301 can be removed from the housing 306 so that the housing 306 can be repositioned. To maintain the housing 306 in each of its various positions, protrusions 318 are provided on opposite ends of the housing 306 and are configured to mate with recesses 328 in each of the support posts 301. When the desired position is achieved, the support posts 301 can be reattached to the housing 306 to maintain the toy 300 in the appropriate orientation.

To accommodate the movement of the toy 300 from the first configuration illustrated in FIG. 8 to the second configuration illustrated in FIG. 9, the support posts 301 can be reconfigured. Each support post 301 includes a movable portion 309 and a fixed portion 319. Movable portion 309 can be removed and repositioned within the fixed-length portion 319 of the support 301 or can be pivotally coupled to the fixed-length portion 319 of the support post 301 to modify the height of the support 301.

The audible output associated with actuation of the actuators 310, 322 can be controlled by a controller 360, similar to that for toy 200, and modified by a mode selector switch (not shown). For example, in one mode, the output can be musical tones associated with various songs. In another mode of operation, the output can be randomly selected musical notes. Regardless of the mode of operation, when the audible output is produced, the light sources are illuminated to present the appearance that the various articles 340 are voicing the tones of the musical output. The tones may be output as long as an actuator 310, 322 is being depressed. Alternatively, the tones may be output for a predetermined amount of time. Depending on the mode of use, each successive actuation of an actuator may cause the output of a different song.

The light sources 343 disposed behind each of the articles 340 may be randomly illuminated or may be illuminated to coincide with the particular actuator 310 that is depressed. When various songs are being output, the light sources 343 may be illuminated regardless of what tone is being produced (i.e., in a random fashion).

Figure 13:
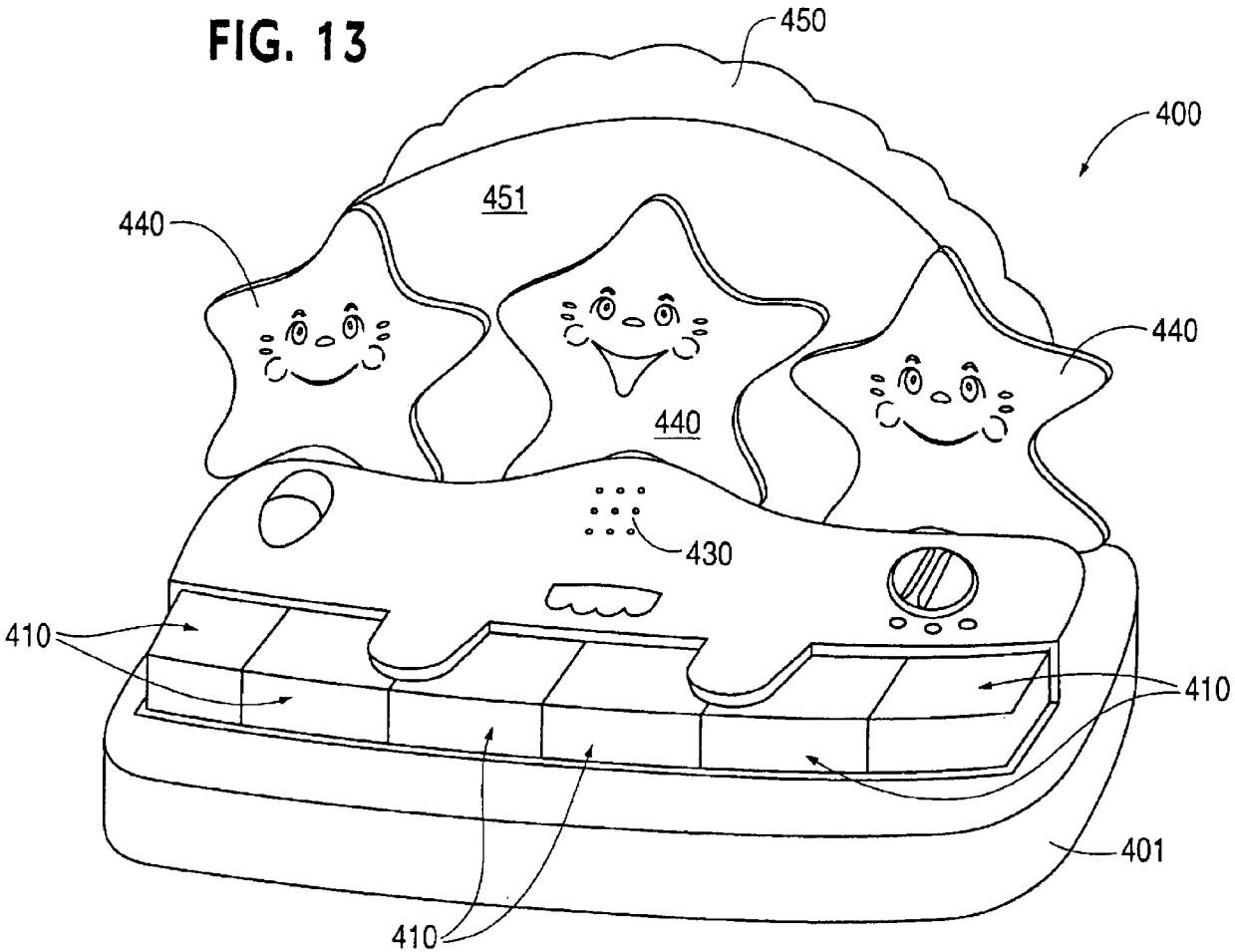
FIG. 13 is a perspective view of another embodiment of a toy embodying the principles of the invention.

A further implementation of the toy 10 is now described with reference to FIG. 13. In the illustrated embodiment, a toy 400 includes a housing 401, input actuators 410, an elevated back member 450, and articles 440. Each article 440 includes an image of facial features disposed on an exterior surface of the article with a corresponding facial feature in a second position disposed on its interior surface as discussed above with respect to articles 206 and 340.

When the input actuators 410 are actuated, light sources (not illustrated) within each article 440 are illuminated, thereby causing the facial features to appear to be moving in correlation with the audible output being produced as discussed above. Audible output is produced via a speaker 430. The audible output associated with actuation of the actuators 410 can be controlled by a controller, similar to that for toy 200, and modified by a mode selector switch 460.

Each of the articles 440 may also include a transparent portion (not illustrated) as discussed above with respect to articles 340. When the light sources in the various articles 440 are illuminated, light can pass through the transparent portion and be reflected off reflective surface 451 of the elevated member 450.

The toy 400 can also include a mode selector switch 460, that can be used to change the output modes as discussed above with respect to toy 300.

Upon depression of the input actuator 410, the articles 440 may move up and down in conjunction with depression and release of the input actuator 410, respectively.

As with the previous embodiments, the light source within the article 440 is illuminated in correlation with the output of tones. Accordingly, the facial features on the article 440 appear to change positions such that the articles 440 appear to be voicing the tones that are output.

Figure 14:
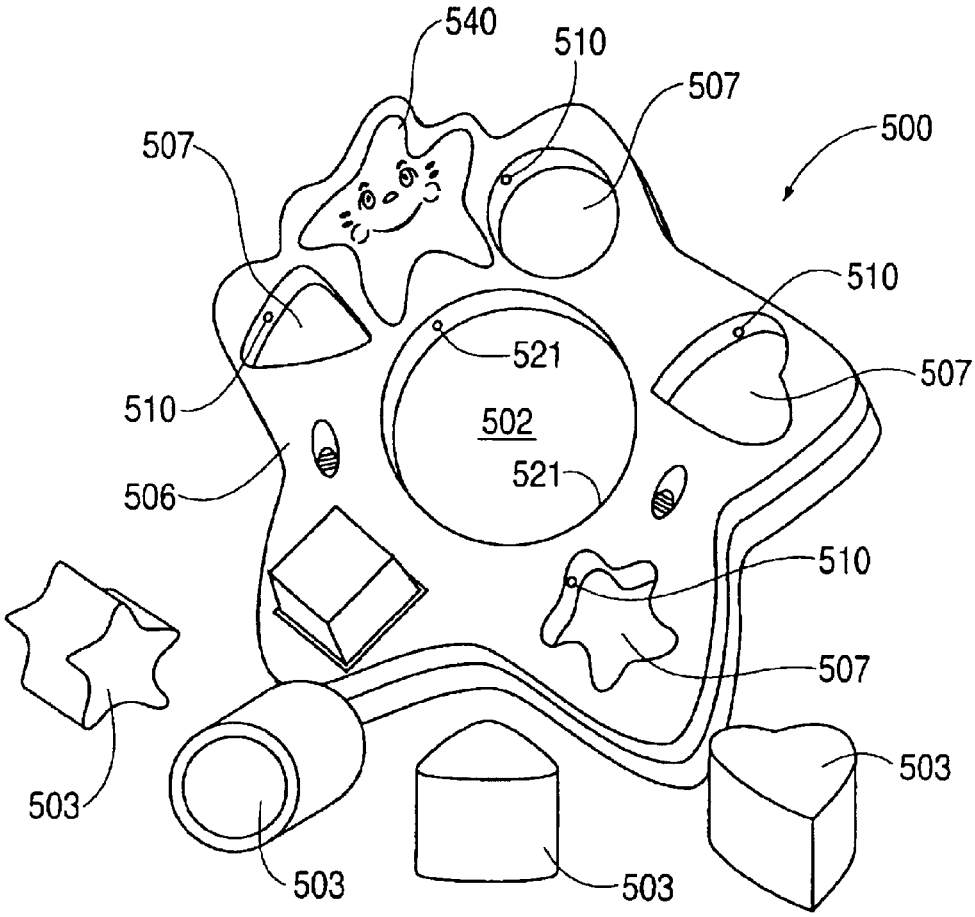
FIG. 14 is a perspective view of a further embodiment of a toy embodying the principles of the invention.

A further implementation of the toy 10 is now described with reference to FIG. 14. In the illustrated embodiment, the toy 500 includes a housing 506 that includes multiple openings 507 disposed about the perimeter of the housing 506 and includes a centrally located opening 502. An article 540 is disposed on the upper portion of the housing 506 and includes an image of facial on its exterior surface. Alternative positions of one or more of the facial features are included on the interior surface of the article 540 as discussed above. When a light source (not illustrated) is illuminated, the facial features appear to be changing positions as previously described.

Each of the openings 507 in the housing 506 includes an actuator 510 that causes the actuation of audible and visual outputs as discussed with respect to the other embodiments described above. Multiple objects 503 can be placed in their corresponding openings 507, thereby actuating the corresponding actuator 510. In operation, when an article is placed in one of the openings, the light source is illuminated in correlation with the audible output, thereby providing the appearance that the article 540 is voicing the tones being produced.

Opening 502 can include an actuator 521. In the illustrated embodiment, the actuator 521 includes a photo emitter/receiver. When the signal from the photo emitter is interrupted, audible output and visual output will be produced as discussed above.

The audible output associated with actuation of the actuators 510, 521 can be controlled by a controller, similar to that for toy 200, and modified by a mode selector switch (not shown).

Figure 15:
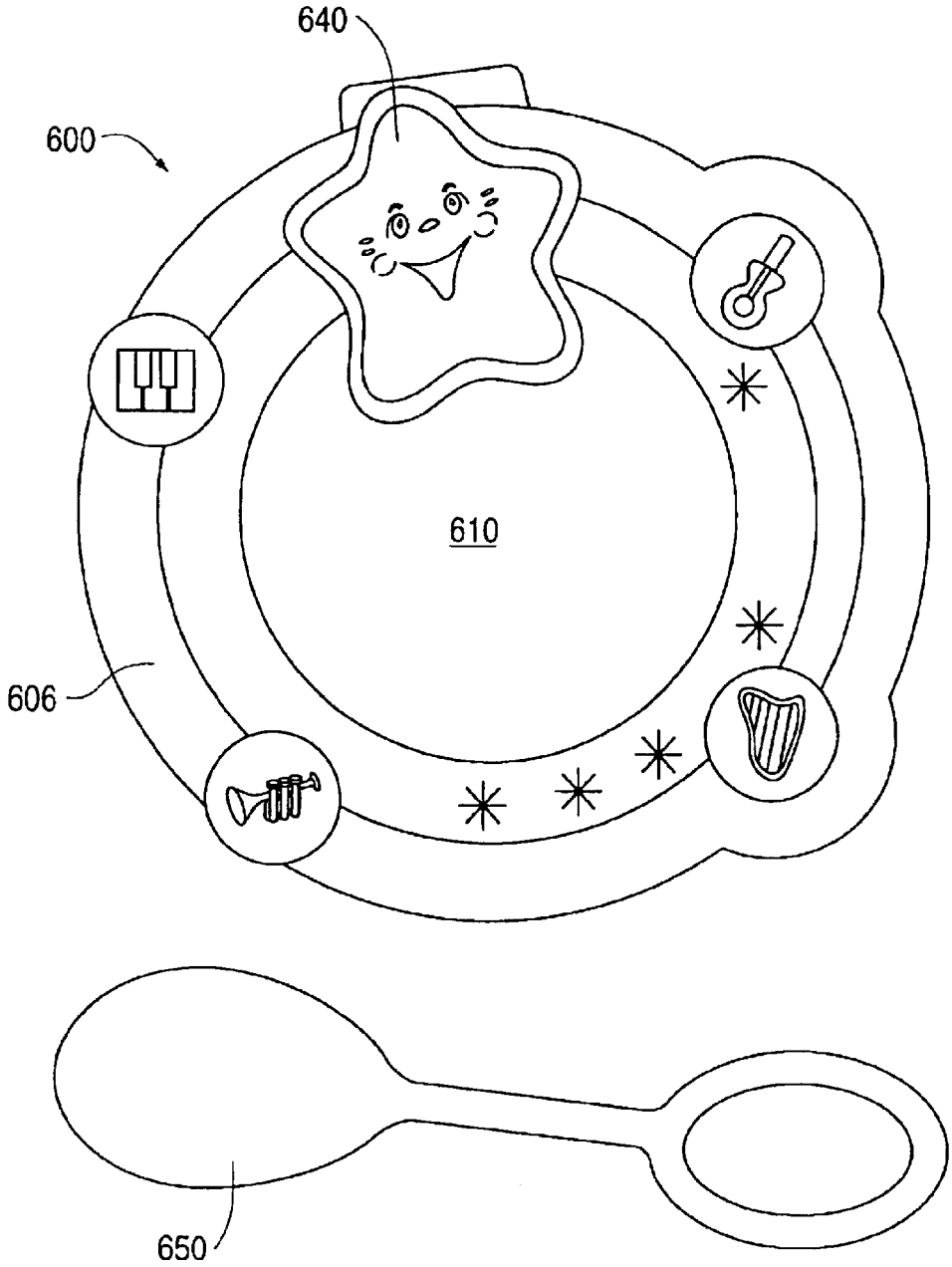
FIG. 15 is a perspective view of a further embodiment of a toy embodying the principles of the invention.

A further implementation of the toy 10 is now described with reference to FIG. 15. In the illustrated embodiment, the toy 600 includes a housing 606 that includes a strike surface 610. An article 640 is disposed on the upper portion of the housing 606 and includes an image of facial on its exterior surface. Alternative positions of one or more of the facial features are included on the interior surface of the article 640 as discussed above. When a light source (not illustrated) is illuminated, the facial features appear to be changing positions as previously described.

Beneath the strike surface 610 is a switch (not illustrated) that is actuated each time the strike surface is contacted with a sufficient amount of force (e.g., one pound of force). The strike surface 610 can be contacted with a user's hand or a separate striking instrument 650. When the switch is actuated, the light source is illuminated in correlation with the audible output, thereby providing the appearance that the article 640 is voicing the tones being produced.

Lenses 660 are positioned around the perimeter of the upper housing 606 of the toy 600. Light sources can be disposes behind each of the light sources and can be selectively illuminated upon actuation of the switch as described above. The lenses can include various images, such as musical instruments, printed thereon.

The audible output associated with actuation of the actuator 610 can be controlled by a controller, similar to that for toy 200, and modified by a mode selector switch (not shown).

In the illustrated embodiment, the various components, buttons, etc. are formed of plastic materials, but any other material suitable for use can be used. Moreover, any of the above-described toys 200, 300, 400, 500, 600 can include on/off switches, mode select switches, and/or volume switches to be able to modify the effect of the audible and visual output. Moreover, any of the features described with respect to any of the embodiments may be utilized with any of the disclosed embodiments. For example, while only toy 300 includes a detailed discussion of reconfigurability with respect to a support surface, any of the toys can be reconfigured or repositioned in various orientations for multiple stages of development.

While particular, illustrative embodiments have been described, numerous variations and modifications exist that would not depart from the scope of the invention. For example, while the various articles 240, 340, 440, 540, 640 have been illustrated as star shaped in configuration with facial features disposed thereon, the articles can be any configuration such as human in form and/or animal like.

Although the various articles 240, 340, 440, 540, 640 as described above are translucent, in an alternative embodiment, the various articles may be either partially translucent and/or transparent. Alternatively, only a portion of each article may be translucent and/or transparent.

Although toy 200 is illustrated as having a cylindrical support post 220 and articles 203 with cylindrical openings, in alternative embodiments, any configuration of support post 220 and articles 203 that allow the two to be slidably engaged is contemplated by the invention. Moreover, in alternative embodiments, any of the articles 203 may be dimensioned, or may contain grooves (not illustrated), to allow the article to be placed on the support post 220 without engaging the actuator 210.

Although toy 200 is disclosed as having separate actuators 210, 211, in an alternative embodiment, the toy 200 may include a single actuator that is positioned such that it can be engaged by articles 203 as well as top article 206.

Although actuator 210 is disclosed as being positioned adjacent the top of support post 220, in an alternative embodiment, actuator 210 can be positioned at any location along the length of support post 220 or on the base 204.

With respect to toy 300, although the housing and supports 301 are disclosed as being separable in order to be repositioned, in an alternative embodiment, the housing may be pivotably coupled to the supports 301.

CONCLUSION

While various embodiments of the invention have been described above, it should be understood that they have been presented by way of example only, and not limitation. Thus, the breadth and scope of the invention should not be limited by any of the above-described embodiments, but should be defined only in accordance with the following claims and their equivalents.

The previous description of the embodiments is provided to enable any person skilled in the art to make or use the invention. While the invention has been particularly shown and described with reference to embodiments thereof, it will be understood by those skilled in the art that various changes in form and details may be made therein without departing from the spirit and scope of the invention.

What is claimed is:

1. A toy, comprising:

a base;

a post having a first end coupled to said base and a second end;

a plurality of rings, each of said plurality of rings adapted to be removably coupled to said post;

an object having a translucent portion adapted to be coupled to the second end of said post;

a light source disposed to illuminate said object when said light source is illuminated; and an audible output generator.

2. The toy of claim 1, wherein said object is a star.

3. The toy of claim 1, wherein said translucent portion includes a first image disposed on an exterior surface of said translucent portion and a second image disposed on an interior surface of said translucent portion, such that when said light source is illuminated, said second image is visible through said translucent portion.

4. The toy of claim 3, wherein said first image is a face with a mouth in a closed position and said second image is the face with the mouth in an open position.

5. The toy of claim 3, wherein said audible output generator is configured to produce vocals of a song and said light source is illuminated simultaneously with the vocals.

6. A toy comprising:

a support having a first engagement portion and a second engagement portion;

a first article having an engagement portion adapted to engage said first engagement portion of said support such that said support and said first article can be releasably coupled together;

a second article having a translucent portion and an engagement portion adapted to engage said second engagement portion of said support such that said support and said second article can be releasably coupled together;

a light source disposed to illuminate said second article, the light being visible through said translucent portion when said light source is illuminated; and an actuator operatively coupled to said sensory output generator and operable to selectively initiate operation of said sensory output generator.

7. The toy of claim 6 wherein said actuator initiates operation of said sensory output generator when said second engagement portion engages said second article engagement portion.

8. The toy of claim 6, further including an audio output generator operable to selectively initiate audio output.

9. The toy of claim 6, wherein said translucent portion includes a first image disposed on an exterior surface of said translucent portion and a second image disposed on an interior surface of said translucent portion, such that when said light source is illuminated, said second image is visible through said translucent portion.

10. An assembly, comprising:

a support having a base;

a member extending from said base; and an actuator disposed on the member and being operatively coupled to an audible output generator; and an article releasably engageable with said support, said article having:

a body portion including an engagement portion disposed on said body portion, said engagement portion adapted to releasably engage the member, said body portion including an inner surface and an outer surface; and a light source, wherein when said engagement portion of said body portion engages said actuator, an audible output is generated by said audio output generator and said light source is illuminated.

11. The assembly of claim 10, wherein said body portion is translucent, said light source is disposed within said body portion, and when said light source is illuminated, light is visible through said body portion.

12. The assembly of claim 10, said body portion further comprising:

a first image disposed on the outer surface of said body portion; and a second image disposed on the inner surface of said body portion, wherein when said light source is illuminated, said second image is visible through said body portion.

13. The assembly of claim 12, wherein said light source and said audible output are actuated simultaneously.

14. The assembly of claim 12, wherein said first image is a face with a closed mouth and said second image is a face with a closed mouth and said audible output includes vocals from a song, whereby when said light source is illuminated and the vocals are output, the first and second image together simulate a mouth moving in unison with the vocals.

15. The assembly of claim 10, wherein said engagement portion includes an opening formed in said body portion, said opening adapted to allow insertion of the member into said body portion to releasably engage said body portion to the support member.

16. A toy, comprising:

a translucent body having a first surface and a second surface;

a light source disposed opposite said first surface; said first surface including an image of a facial feature in a first position and said second surface including an image of the facial feature in a second position, such that when said light source is illuminated, the facial feature appears to be in said first position and when said light source is not illuminated, the facial feature appears to be in said second position; and an audible output generator operable to produce an audible output simultaneously with illumination of said light source.

17. The toy of claim 16, wherein said facial feature is a mouth and said first position is an open mouth and said second position is a closed mouth.

18. The toy of claim 16, wherein said facial feature is an eye and said first position is an open eye and said second position is a closed eye.

19. The toy of claim 16, wherein said facial feature is a mouth and said first position is an open mouth and said second position is a closed mouth and said audible output includes vocals from a song, whereby when said light source is illuminated and the vocals are output, the mouth moves in unison with the vocals.

20. A stacking articles toy comprising:

a base having an upper surface;

a post extending from said base and having a first end coupled to said base and a second end;

a plurality of articles, each of said plurality of articles including a body portion having an engagement portion adapted to releasably engage said post and to be stackable on said upper surface of said base;

an object coupled to said second end of said post, said object including a translucent body portion; and a light source disposed to illuminate said object through said translucent body portion.

21. The stacking articles toy of claim 20, wherein said engagement portion includes an opening formed through said body portion, said opening adapted to allow placement of each of said plurality of articles onto said post.

22. The stacking articles toy of claim 20, wherein said body portion of said object includes an opening formed in said body portion adapted to receive said second end of said post.

23. The stacking articles toy of claim 20, further including:

a sensory output generator disposed on said base;

a first actuator disposed on said post, said first actuator operatively coupled to said sensory output generator and operable to initiate operation of said sensory output generator when one of said plurality of articles is disposed onto said post; and a second actuator disposed on said post, said second actuator operatively coupled to said light source and operable to illuminate said light source and thereby illuminate said object when said object is disposed onto said second end of said post.

24. The stacking articles toy of claim 20, wherein said light source is disposed within said post.

25. The stacking articles toy of claim 20, wherein said light source is disposed within said body of said object.

26. A toy, comprising:

an aperture;

an actuator disposed within the aperture;

a translucent body having a first surface and a second surface;

a light source disposed opposite said first surface, said first surface including an image of a facial feature in a first position and said second surface including an image of the facial feature in a second position, such that when said light source is illuminated, the facial feature appears to be in said first position and when said light source is not illuminated, the facial feature appears to be in said second position; and an audible output generator operable to produce an audible output simultaneously with illumination of said light source, and wherein said actuator is configured to initiate illumination of said light source and simultaneous production of the audible output.

27. A toy comprising:

a housing;

a pair of supports coupled to the housing, the supports each being reconfigurable between a first configuration and a second configuration such that in the first configuration the housing is a first distance above a support surface and in the second configuration the housing is a second distance, different from the first distance, above the support surface;

an actuator coupled to the housing;

an article, at least a portion of which being translucent, the article having a first surface and a second surface;

a light source disposed opposite said first surface, said first surface including an image of a facial feature in a first position and said second surface including an image of the facial feature in a second position, such that when said light source is illuminated, the facial feature appears to be in said first position and when said light source is not illuminated, the facial feature appears to be in said second position; and an audible output generator operable to produce an audible output simultaneously with illumination of said light source, and wherein said actuator is configured to initiate illumination of said light and simultaneous production of the audible output.

* * * * *